US011027571B2

(12) United States Patent
Garbos et al.

(10) Patent No.: US 11,027,571 B2
(45) Date of Patent: Jun. 8, 2021

(54) RECORDABLE GREETING CARD WITH USER-DEFINABLE TOUCH ZONES

(71) Applicant: HALLMARK CARDS, INCORPORATED, Kansas City, MO (US)

(72) Inventors: Jennifer R. Garbos, Kansas City, MO (US); Tyler James Richmond, Roeland Park, KS (US); Christopher Jason Shields, Kansas City, MO (US); Nicholas Pedersen, Lawrence, KS (US); Danielle M. Caldwell, Kansas City, MO (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 4 days.

(21) Appl. No.: 16/155,865

(22) Filed: Oct. 9, 2018

(65) Prior Publication Data

US 2019/0054755 A1 Feb. 21, 2019

Related U.S. Application Data

(63) Continuation-in-part of application No. 14/541,840, filed on Nov. 14, 2014, now abandoned.

(51) Int. Cl.
*B42D 15/04* (2006.01)
*B42D 15/02* (2006.01)

(52) U.S. Cl.
CPC ..... *B42D 15/047* (2013.01); *B42D 15/022* (2013.01); *B42D 15/042* (2013.01)

(58) Field of Classification Search
None
See application file for complete search history.

(56) References Cited

U.S. PATENT DOCUMENTS

| | | | |
|---|---|---|---|
| 5,504,836 | A | 4/1996 | Loudermilk |
| 5,956,682 | A | 9/1999 | Loudermilk et al. |
| 6,185,851 | B1 | 2/2001 | Loudermilk et al. |
| 6,263,310 | B1 | 7/2001 | Loudermilk et al. |

(Continued)

OTHER PUBLICATIONS

Canadian Office Action received for Canadian Patent Application No. 3,057,922, dated Jan. 4, 2021, 5 pages.

*Primary Examiner* — Christopher R Lamb
(74) *Attorney, Agent, or Firm* — Shook, Hardy & Bacon, L.L.P.

(57) ABSTRACT

A greeting card and associated techniques for storing audio tracks corresponding to definable touch zones of the greeting card is provided. In one aspect, the greeting card includes a body for securing a photograph thereon. A sensor array can be disposed within the body of the greeting card to detect touch gestures through the secured photograph, among other things. The greeting card can include a microprocessor that enables touch zones to be defined via the sensor array, such that a touch zone can correspond to various objects depicted on the card or a photograph secured thereon. Among other things, the greeting card can include a microphone for recording an audio track corresponding to each generated touch zone, a speaker for playing back an audio track corresponding to a selected touch zone, and a memory for storing touch zones and/or associated audio tracks.

12 Claims, 9 Drawing Sheets

(56) References Cited

U.S. PATENT DOCUMENTS

| | | | | |
|---|---|---|---|---|
| 6,377,926 | B2 | 4/2002 | Loudermilk | |
| 6,381,573 | B1 | 4/2002 | Loudermilk | |
| 6,393,401 | B1 | 5/2002 | Loudermilk et al. | |
| 6,393,402 | B1 | 5/2002 | Loudermilk et al. | |
| 2005/0179947 | A1 | 8/2005 | Kobashi et al. | |
| 2010/0151830 | A1* | 6/2010 | Raffle | H04M 1/7253 455/412.1 |
| 2010/0250255 | A1* | 9/2010 | Stern | H04N 1/00188 704/272 |
| 2012/0098946 | A1 | 4/2012 | Seung | |
| 2013/0074380 | A1* | 3/2013 | Mayer | B42D 15/022 40/124.03 |
| 2014/0096074 | A1 | 4/2014 | Dojo et al. | |
| 2015/0067546 | A1 | 3/2015 | Shuto | |
| 2015/0220249 | A1 | 8/2015 | Snibbe et al. | |
| 2015/0301789 | A1 | 10/2015 | Youn et al. | |
| 2015/0324032 | A1* | 11/2015 | Stone | G06F 3/044 345/174 |
| 2016/0274696 | A1* | 9/2016 | Hsu | G06F 3/044 |

* cited by examiner

RECORDABLE GREETING CARD WITH USER-DEFINABLE TOUCH ZONES

CROSS-REFERENCE TO RELATED APPLICATIONS

This application is a continuation-in-part and claims priority to U.S. patent application Ser. No. 14/541,840, titled "Recordable Photo Frame With User-Definable Touch Zones," and filed on Nov. 14, 2014, which is assigned or under obligation of assignment to the same entity as this application, the entire contents of the aforementioned application being herein incorporated by reference.

BACKGROUND

Greeting cards traditionally serve as a medium for relaying personal notes, messages, or other pleasantries in the form of written memorandums. Greeting cards are oftentimes gifted to friends and family to serve as a means for communicating personalized messages to a recipient. The recipient typically reads the written messages to acknowledge who the card or an associated gift is from, or to reminisce about events that are oftentimes relayed through the written messages. Written messages, however personalized, only encompass limited dimensions of communication. Other means of communication, such as voice, can deliver additional dimensions of communication and can relay additional context from one individual to another. For instance, sarcasm can sometimes be relayed through voice better than in written form. Congratulatory messages expressed through voice communications can also express an additional dimension of excitement that is oftentimes difficult to relay through written communication. Accordingly, there is a need for a greeting card that allows one or more signatories or contributors to capture their own audible messages for audible relay to the recipient. Additionally, as greeting cards can be designed differently, there is also a need for a greeting card that associates the audible messages with user-definable portions of the greeting card.

SUMMARY

Embodiments of the present disclosure are defined by the claims below, not this summary. A high-level overview of various aspects of the present disclosure are provided here for that reason, to provide an overview of the disclosure, and to introduce a selection of concepts that are further described in the Detailed Description section below. This summary is not intended to identify key features or essential features of the claimed subject matter, nor is it intended to be used as an aid in isolation to determine the scope of the claimed subject matter.

In brief and at a high level, this disclosure describes, among other things, a greeting card and methods for storing audio tracks and associating them with programmable touch zones on a body of a greeting card. The greeting card includes an audible greeting assembly that is at least partially disposed within a body of the card. The audible greeting assembly includes a sensor array having a plurality of sensors that face towards and interface with a front portion of the card body, such that touch gestures can be detected by the sensor array through at least the front portion of the card body. The sensor array is coupled to a microprocessor that enables, while in a recording mode, the generation of user-defined touch zones based on encircling touch gestures received via the sensor array through at least the front portion of the card body. The greeting card also includes a microphone for receiving audio associated with each generated touch for storage in a memory. In some further embodiments, the microprocessor can determine, while in a playback mode, a selected touch zone based on a determination that a received touch gesture (e.g., a touch or push) corresponds to a generated touch zone. Based on the selected touch zone, the microprocessor can play back the stored audio associated with the generated touch zone through a speaker of the audible greeting assembly.

This summary is provided to introduce a selection of concepts in a simplified form. These concepts are further described below in the detailed description of the preferred embodiments. Various other aspects and advantages of the present disclosure will be apparent from the following detailed description of the preferred embodiments and the accompanying drawing figures.

DESCRIPTION OF THE DRAWINGS

Illustrative embodiments of the present disclosure are described in detail below with reference to the attached drawing figures, and wherein.

Figure 2A:
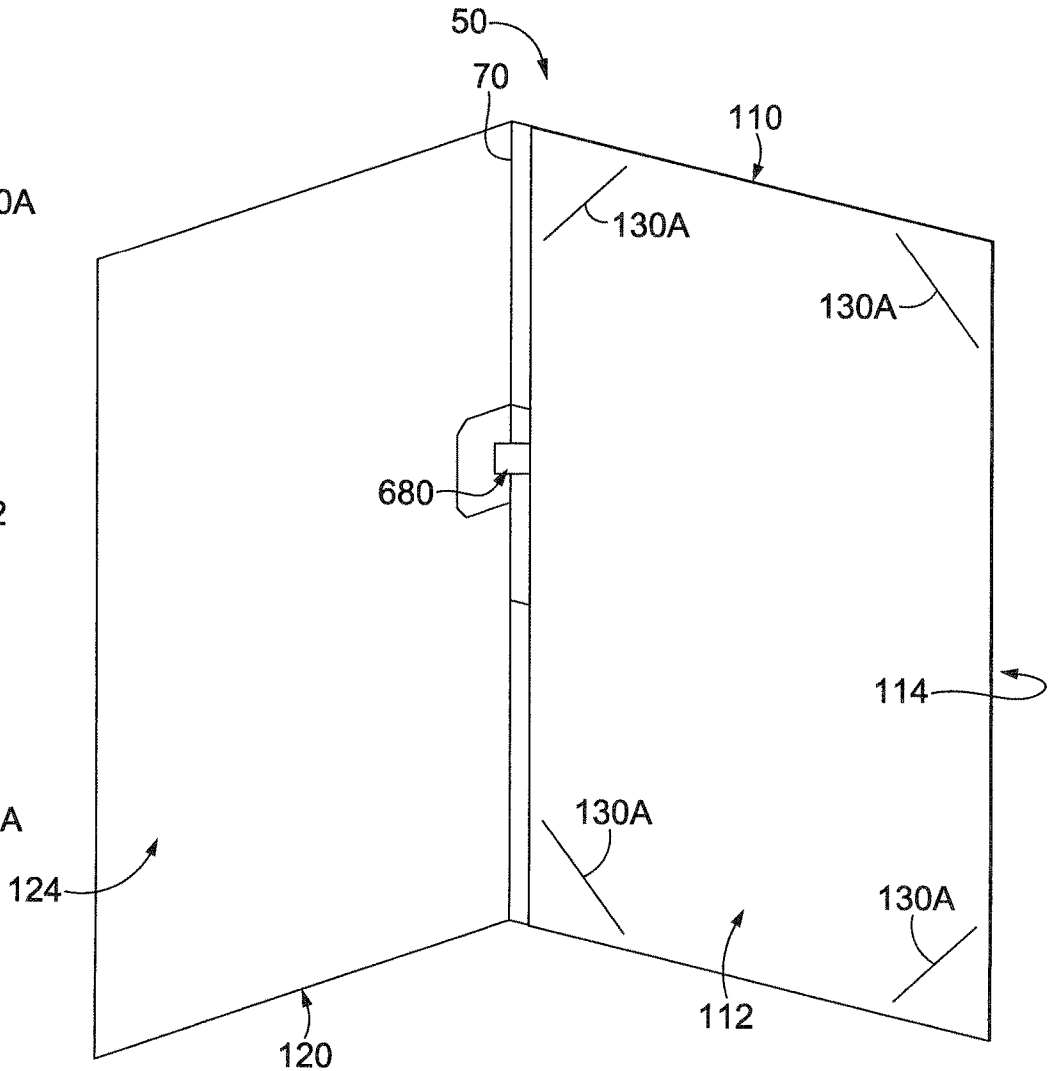
FIG. 2A is a front perspective view of the greeting card assembly of FIG. 1, particularly illustrating the greeting card in an open state and presenting slots for securing pictures thereto, in accordance with an aspect of the disclosure.

The drawing figures do not limit embodiments of the present disclosure to the specific embodiments disclosed and described herein. The drawings are not necessarily to scale, emphasis instead being placed upon clearly illustrating the principles of the preferred embodiments.

DETAILED DESCRIPTION

The subject matter of select embodiments of the present disclosure is described with specificity herein to meet statutory requirements. But, the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Methods and devices are described herein for recording, storing and associating audio tracks with generated touch zones corresponding to user-defined areas of a greeting card. In particular, embodiments of the present disclosure are directed to a greeting card (hereinafter also referenced as "card") having an audible greeting assembly disposed between a front and a rear portion of a card body and/or a content portion of the card. In various embodiments described herein, a card body corresponds to a non-folded portion of the card, whereby a front portion of the card includes a visible surface that can receive custom inscriptions (e.g., with a pen, pencil, writing tool), present a printed graphics design, and/or include a photograph securement means to removably secure a photograph (e.g., a tangible photograph printed or developed on a photographic medium) to the visible surface. In various embodiments, the card can include a stock card (e.g., a non-folding card), a bi-fold card (e.g., card having a single fold having a cover portion and a card body), or a multi-fold card (e.g., card having multiple folds having at least a cover portion and a card body).

The audible greeting assembly can include a sensor array presenting a plurality of sensors (e.g., capacitive, pressure-sensitive) that are operable to detect touch gestures (e.g., touches, pushes, swipes) having at least a threshold level of capacitance (also referenced herein as "presence"), pressure, or the like, necessary for detection by the sensors. In other words, touch gestures having at least the threshold level of pressure or presence can be detected by the sensors through at least the front portion of the card body. In some further embodiments, the touch gestures having at least the threshold level of pressure or presence can also be detected through additional pages of the card, a photographic securement means, and/or a photograph secured to the card body via the photographic securement means, if applicable. In various embodiments, the audible greeting assembly further includes components, such as a memory, a microprocessor, and a microphone. The microprocessor is coupled to the sensor array and the memory, and is configured to generate one or more touch zones by detecting, via the sensor array, an encircling touch gesture that corresponds to a subset of the sensors. The memory is operable for storing the one or more generated touch zones for association with an audio file generated based on audio received via a microphone. The microphone is coupled to the microprocessor and is operable to receive audio in response to the generation of a touch zone, such that the microprocessor can generate and store into the memory an audio file associated with the generated touch zone based on the received audio.

In some further embodiments, the card is a folding card (e.g., bi-fold, multi-fold), such that the audible greeting assembly further includes a sliding switch (hereinafter referred to as a "switch") having a first slider end secured to a cover portion (e.g., a page of the card immediately preceding the card body and pivotally attached thereto) of the card and a second slider end secured to the card body and/or the audible greeting assembly. The second slider end of the switch can be displaced from a first position when the card is in a closed state, to a second position when the card is in an opened state. To displace the folding card from the closed state to the open state, the cover portion can be pivoted in a direction away from the card body. In some further embodiments, the switch can be employed to decouple and couple a power supply (e.g., a battery) selectively coupled to the audible greeting assembly when in the first and second positions, respectively. In this regard, the switch in the first position (i.e., card in the closed state) can be non-conductive, so as to selectively prevent power to flow from the power source to the audible greeting assembly. To this end, accidental playback of audio files can be prevented when touch gestures are detected on corresponding touch zones when the card is in the closed state. Alternatively, the switch in the second position (i.e., card in the opened state) can be conductive, so as to selectively enable power to flow from the power source to the audible greeting assembly. In this regard, audio files can only be played back when touch gestures are detected on corresponding touch zones when the card is in the opened state.

In some other embodiments, the switch can be employed by the microprocessor to determine whether a first memory bank or a second memory bank of the memory should be employed for generating touch zones, receiving audio, or playing back audio files, among other things. In other words, the switch can be employed to instruct the microprocessor to switch between utilization of first and second memory banks when in the first and second positions, respectively. When the switch is in the first position (i.e., card in the closed state), the microprocessor can generate touch zones and receive audio for storage in the first memory bank, and play back audio files based on detected touch gestures corresponding to generated touch zones stored in the first memory bank. When the switch is in the second position (i.e., card in the opened state), the microprocessor can generate touch zones and receive audio for storage in the second memory bank, and play back audio files based on detected touch gestures corresponding to generated touch zones stored in the second memory bank. In various embodiments, a memory bank is not necessarily limited to different portions of a memory, but can reference an implementation where the microprocessor stores and retrieves data (e.g., touch zones, audio files) into and from the memory, respectively, with a flag indicator corresponding to one of the first and second positions, based on a position of the switch determined by the microprocessor.

Figure 1:
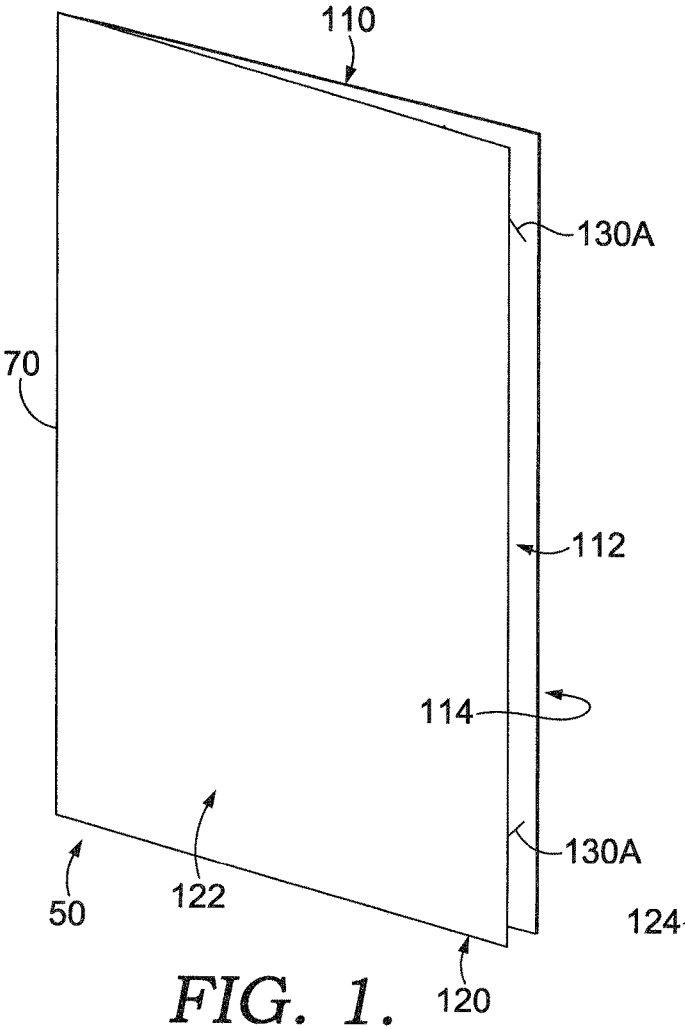
FIG. 1 is a front elevation view of a greeting card assembly for storing and associating audio tracks to generated touch zones, oriented in a substantially closed state in accordance with aspects of the disclosure.

With specific reference now to the figures, methods and devices are described in accordance with embodiments of the present disclosure. Various embodiments are described with respect to the figures in which like elements are depicted with like reference numerals. Referring initially to FIGS. 1-3, according to various embodiments of the present disclosure, a greeting card 50 ("card") is provided having a card body 110 presenting a front portion 112 and a rear portion 114. For example, the front portion 112 can be a first layer and the rear portion can be a second layer of the card body 110 configured to house electronics there between, as later described herein. In some embodiments, the card 50 is a bi-fold card having a single fold 70 that defines a separation between the card body 110 and a cover portion 120 defined by the fold 70. The fold 70 can serve as an axis about which the cover portion 120 can rotate or pivot toward and away from the card body 110 between a closed state and an open state. The card body 110 and/or the cover portion 120 can be comprised of a writeable material (e.g., paper, cloth, plastic) suitable for receiving names, signatures, handwritten messages and/or remarks and/or can be configured to receive pictures, graphics, text, or any indicia thereon via printing, painting, embossing, adhesive, or any method known in the art.

Though the card is generally described as a bi-fold card herein, in accordance with other embodiments of the present disclosure, the card 50 can generally include any type of card (e.g., stock or single page, multi-fold) having at least the card body 110. In other words, in accordance with various embodiments described herein, a card 50 can have the card body 110 with no folds or one or more folds, such as fold 70. Similarly, the card 50 can also have no cover portion or at least one cover portion, such as the cover portion 120 presenting a front surface 122 and a rear surface 124. Each cover portion, in various embodiments, is defined by a fold, and is positioned on a side adjacent to the front portion 112 when the card 50 is in a closed state, as depicted in FIG. 1. In various embodiments described herein, the front and rear portions 112, 114 of the card 50, in addition to one or more cover portions, such as cover portion 120, can comprise any paper-based material or any other material typically utilized for manufacturing greeting cards, as one of ordinary skill may appreciate.

Figure 2B:
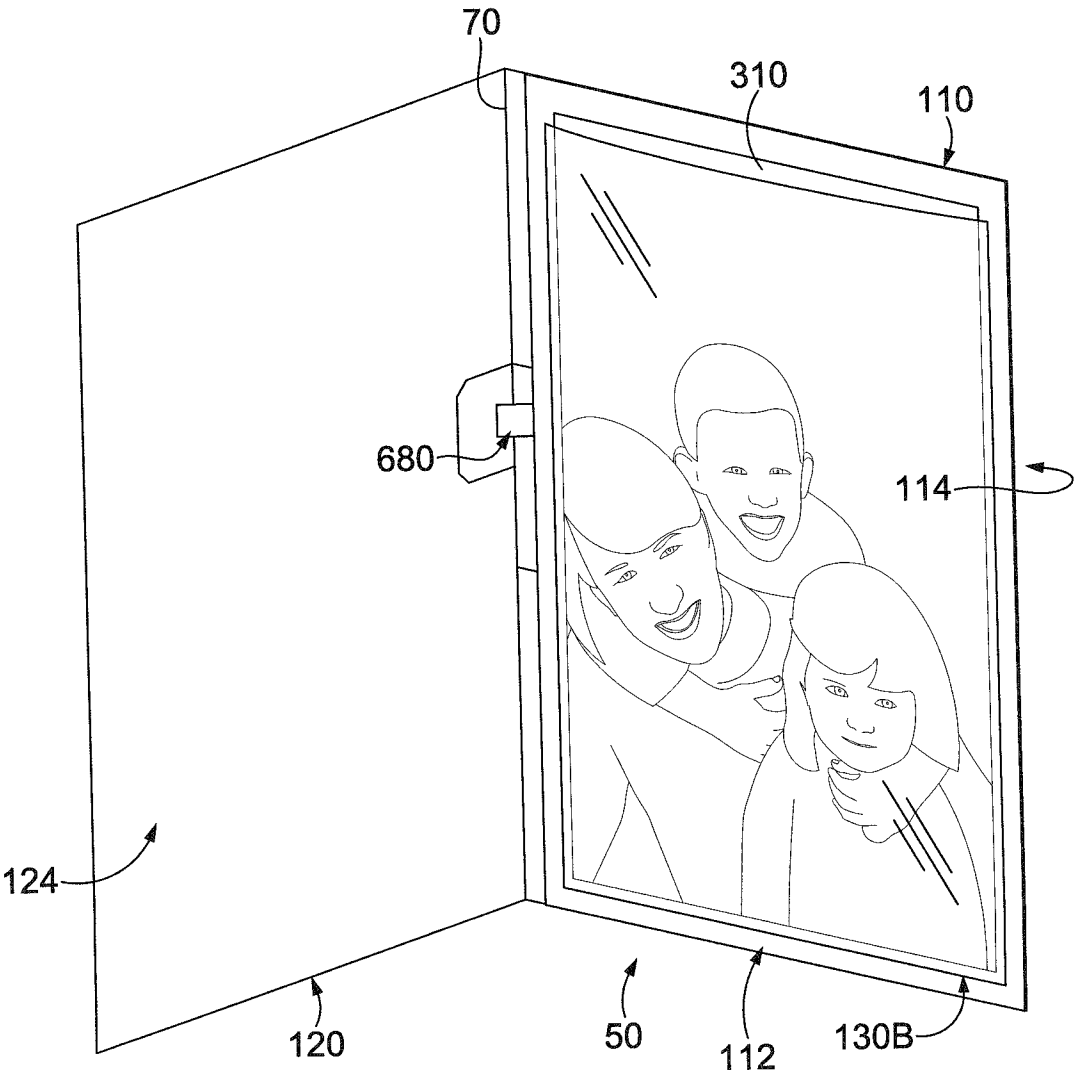
FIG. 2B is a front perspective view of an alternative embodiment of the greeting card assembly of FIG. 1, particularly illustrating an alternative picture attachment arrangement therein.
Figure 3:
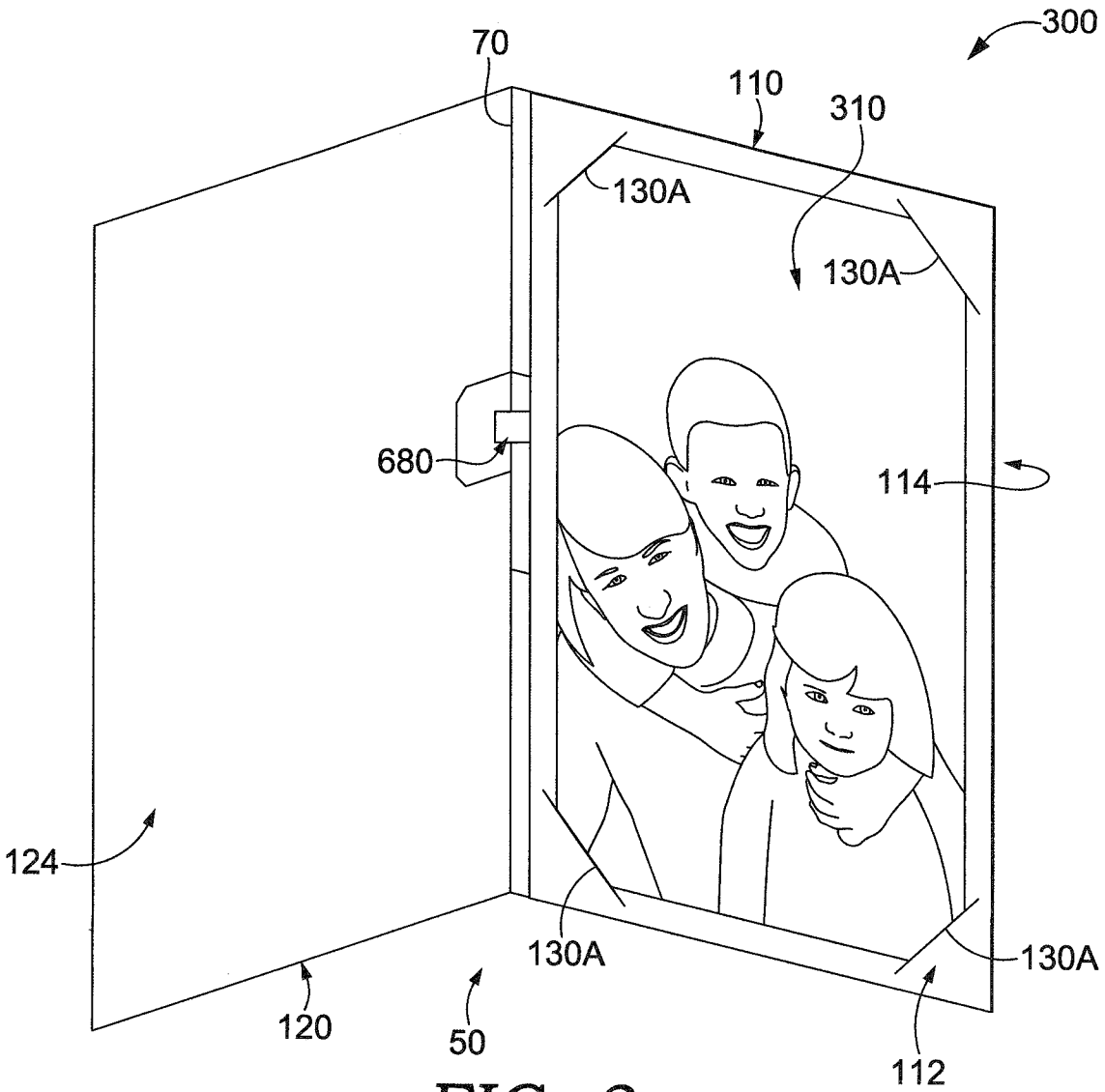
FIG. 3 is a front perspective view of the greeting card assembly of FIG. 2A with a picture attached therein in accordance with an aspect of the disclosure.

The illustrations of FIGS. 2A and 2B depict the card 50 in an opened state. In some embodiments, the card body 110 can include a photograph securement means adapted to removably secure a photograph onto the front portion 112 of the card body 110. In some embodiments, in reference to FIG. 2A, a photograph securement means can include a plurality of corner slots 130A (e.g., openings) that are each positioned at distances that can relatively correspond to corners of a photograph printed in accordance with standard photograph print specifications (e.g., 4"×4", 4"×5.3", 4"×6", 5"×5", 5"×7"). In various embodiments, the plurality of corner slots 130A can be positioned at relative distances slightly greater (e.g., up to 0.25", up to 0.5") than standard photograph print specifications to facilitate a securement and removal process, among other things. FIG. 3 provides an exemplary depiction of the card 50 having a photograph 310 secured to the card body 110 by way of the plurality of corner slots 130A.

In another embodiment, with reference to FIG. 2B, the photograph securement means can include a transparent polymer sleeve 130B that is affixed to the front portion 112 of the card body 110. The polymer sleeve 130B can be affixed (e.g., with an adhesive) to the front portion 112 of the card body 110 to form a pocket presenting an opening that receives a photograph 310 for removable securement to the card body 110. The dimensions of the polymer sleeve 130B can include a relative height and width that is slightly greater (e.g., up to 0.25", up to 0.5") than a photograph 310 printed according to standard photograph print specifications (e.g., 4"×4", 4"×5.3", 4"×6", 5"×5", 5"×7") to facilitate a smoother securement and removal process, among other things. It is contemplated that the sleeve 130B does not need to be limited to a polymer material, but can comprise any other transparent material that can be affixed to the front portion 112 of the card body 110 and can present an opening or pocket to receive and secure the photograph.

Figure 4:
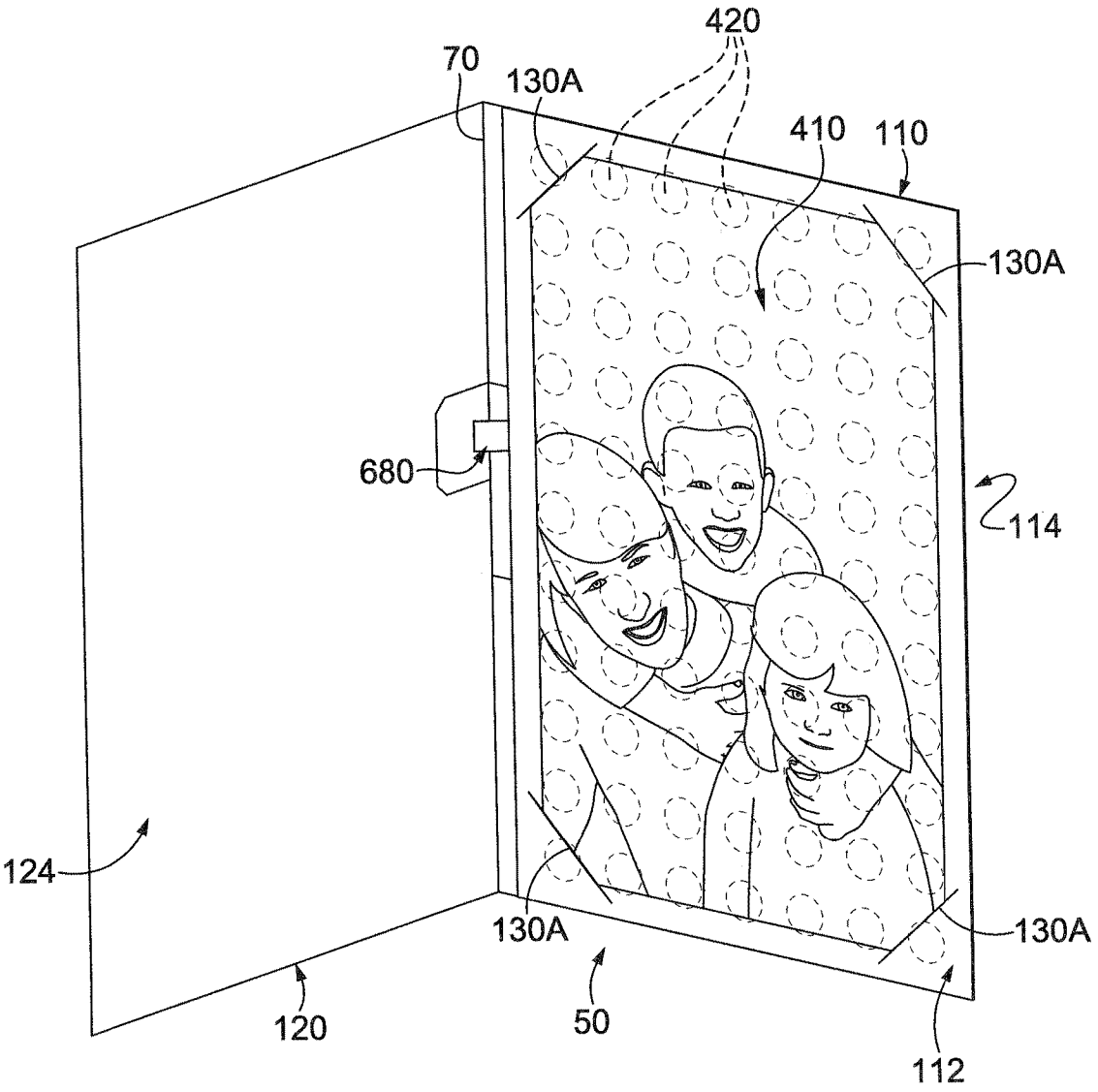
FIG. 4 is a front perspective view of the greeting card assembly of FIG. 3, particularly illustrating a sensor array and the positioning of its sensors with respect to an exemplary picture, in accordance with an aspect of the disclosure.
Figure 5:
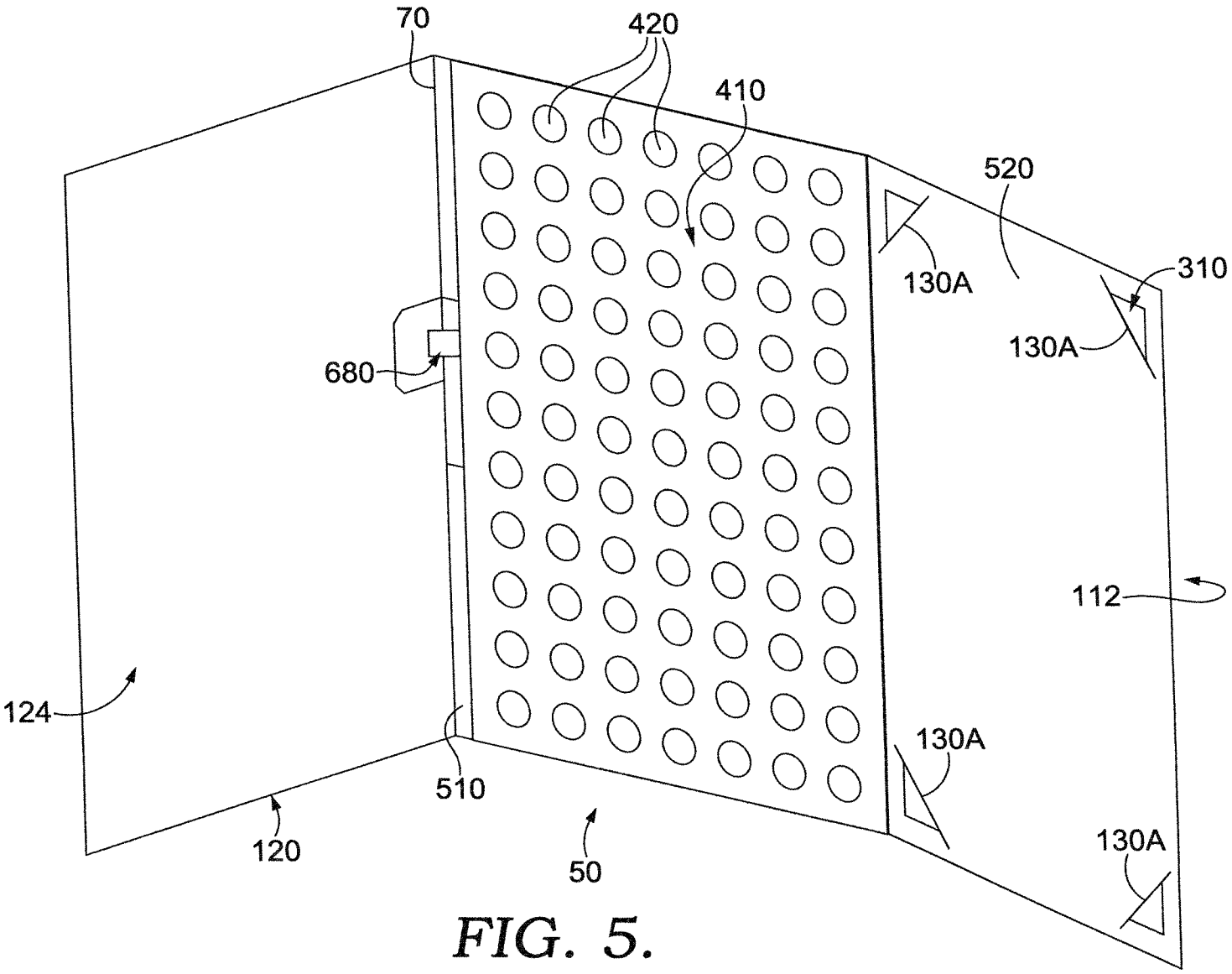
FIG. 5 is a front perspective view of the greeting card assembly of FIG. 3 having a tri-fold configuration and illustrated in a fully-extended state, in accordance with an aspect of the disclosure.
Figure 6:
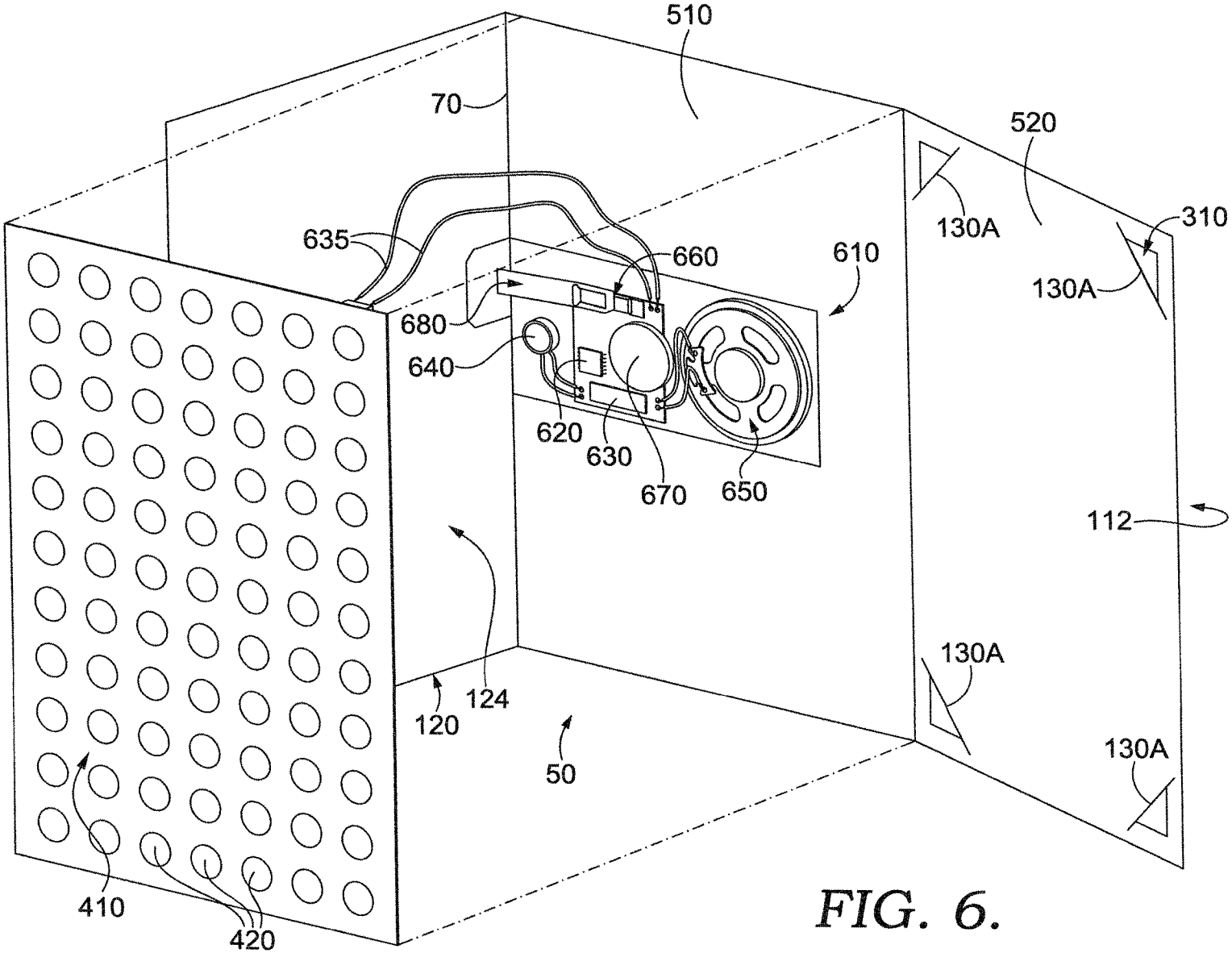
FIG. 6 is an exploded front perspective view of the greeting card assembly of FIG. 5 illustrating components located under the sensor array, in accordance with an aspect of the disclosure.
Figure 7:
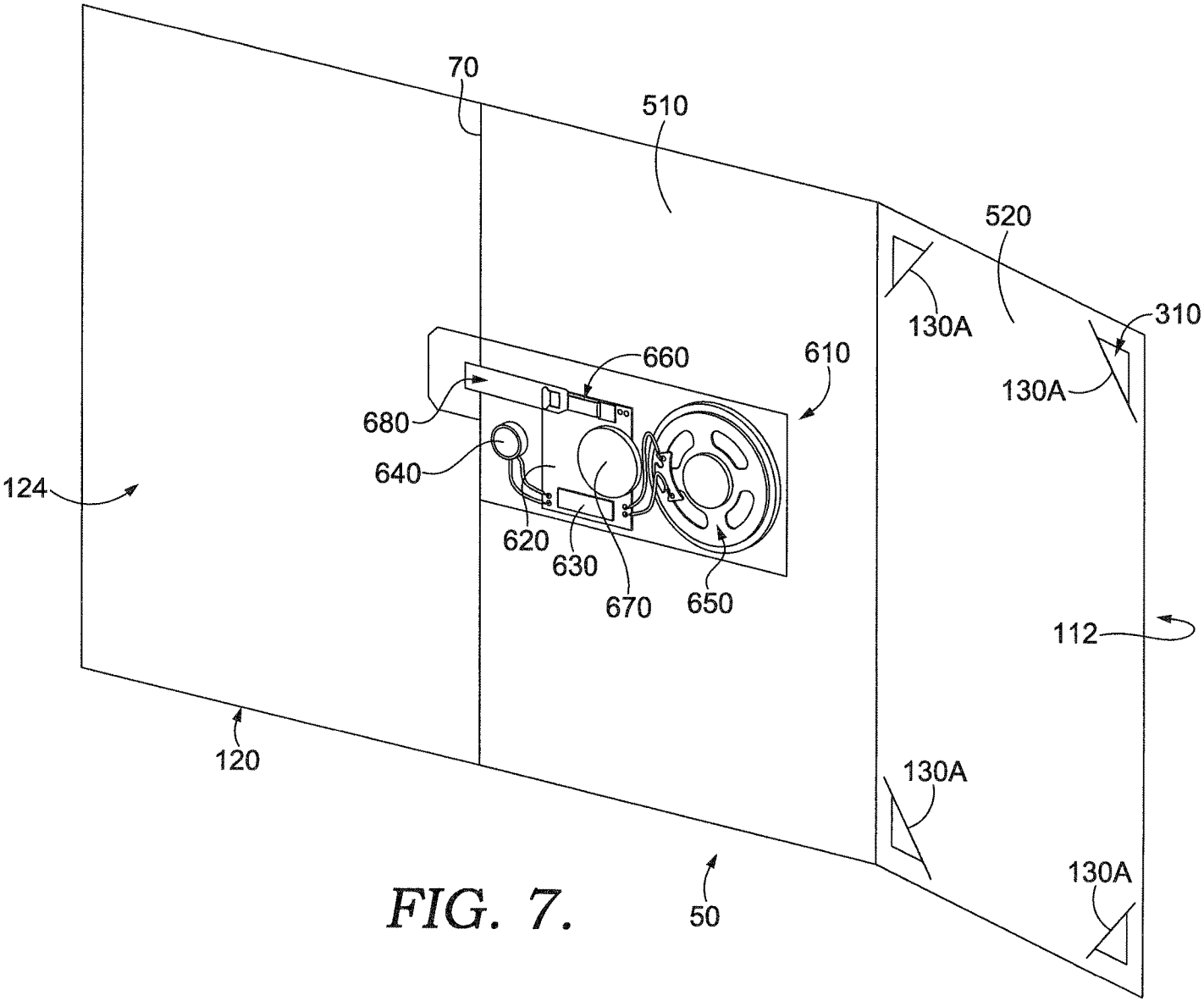
FIG. 7 is elevation front perspective view of the greeting card assembly of FIG. 6 with the sensor array removed to view the components located thereunder, in accordance with an aspect of the disclosure.

The card 50 can include a sensor array 410 disposed within the card body 110, as shown in FIGS. 4-6. The sensor array 410 can include a plurality of sensors 420 operable to detect touch gestures. A variety of types of sensors, such as capacitive sensors, resistive sensors, surface acoustic wave (SAW) sensors, pressure-sensitive sensors, infrared sensors, optical imaging sensors, acoustic pulse recognition sensors, and the like, may be used, as long as the sensors are capable of detecting touch gestures. In some aspects, the sensors can be capable of detecting touch gestures through other materials, such as the front portion 112 of the card body 110, a photograph 310, or a photograph securement means, such as photograph securement means 130B of FIG. 2B. In this regard, the sensors may require a threshold level of pressure to be applied thereon, or a threshold distance or capacitance to be detected, in order for a touch gesture to be detected thereby. The sensor array 410 can be configured for placement behind the image depicted in the exemplary photograph 310, such that the photograph 310 is positioned thereon and touch gestures are detected through the photograph 310 by the sensor array 410. In some embodiments, a rear segment 510 is provided for secured placement behind the sensor array 410, such that the sensor array 410 is interposed between the photograph 310 and rear segment 510. The rear segment 510 of the card body 110 can be substantially identical to the rear portion 114 (e.g., a back cover of the card) described above. While the illustrated embodiments depict the sensor array 410 and rear segment 510 as having substantially similar dimensions to the photograph sizing configuration, it should be understood that sizing may vary while staying within the scope of the present disclosure. Further, it should be understood that the rear segment 510 can be eliminated or interchanged with other materials without departing from the scope of the present disclosure.

In some embodiments of the present disclosure, the card 50 can be configured as a tri-fold card in an unassembled state, as illustrated in FIG. 5, whereby the card in the assembled state can be presented as a bi-fold card, as depicted in FIGS. 1-4. The card 50 can include the rear segment 510 attached to or integrally formed with the card body 110. For example, the rear segment 510 can be pivotally attached to the cover portion 120 and a front portion 112 can be pivotally attached to the rear segment 510 at an edge opposite of the attachment point of the cover portion 120. The front segment 520 can be substantially identical to the front portion 112 of the card body 110 illustrated in FIG. 3, including the corner slots 130A adapted to secure the photograph 310. More specifically, the front segment 520 can include a first outer face and a first inner face, the rear segment 510 can include a second outer face and a second inner face, and the front segment 520 can be at least partially affixed to the rear segment 510 to place the card into the assembled state. Furthermore, the card 50 can be presented or selectively moved in an unassembled state by pivoting the cover portion 120 in a counter-clockwise direction, and pivoting the front segment 520 in a clockwise direction away from the rear segment 510, though the unassembled state is preferably only presentable prior to affixing the rear segment 510 to the front segment 520.

A space (not shown) between the front segment 520 affixed to the rear segment 510 can house an audible greeting assembly 610 of the card 50, which can include electrical components including the sensor array 410. The audible greeting assembly 610 can include the sensor array 410, coupled to a logic board that can directly or indirectly, electrically and/or communicably, couple components including sensor array 410, a speaker 650, a microphone 640, a battery 670 or other such power supply, a memory 630, and one or more microprocessors, such as processors 620. Although not shown, in some embodiments, the logic board of audible greeting assembly 610 can also include a communications bus (such as a USB, Firewire, serial port, etc.) operable for transferring data (i.e., media files) between an external computer-readable media and the memory 630. The logic board of audible greeting assembly 610 is just one method of connecting the electronic components herein. Other electronic and communication connections may be employed without departing from the scope of the present disclosure.

Figure 8:
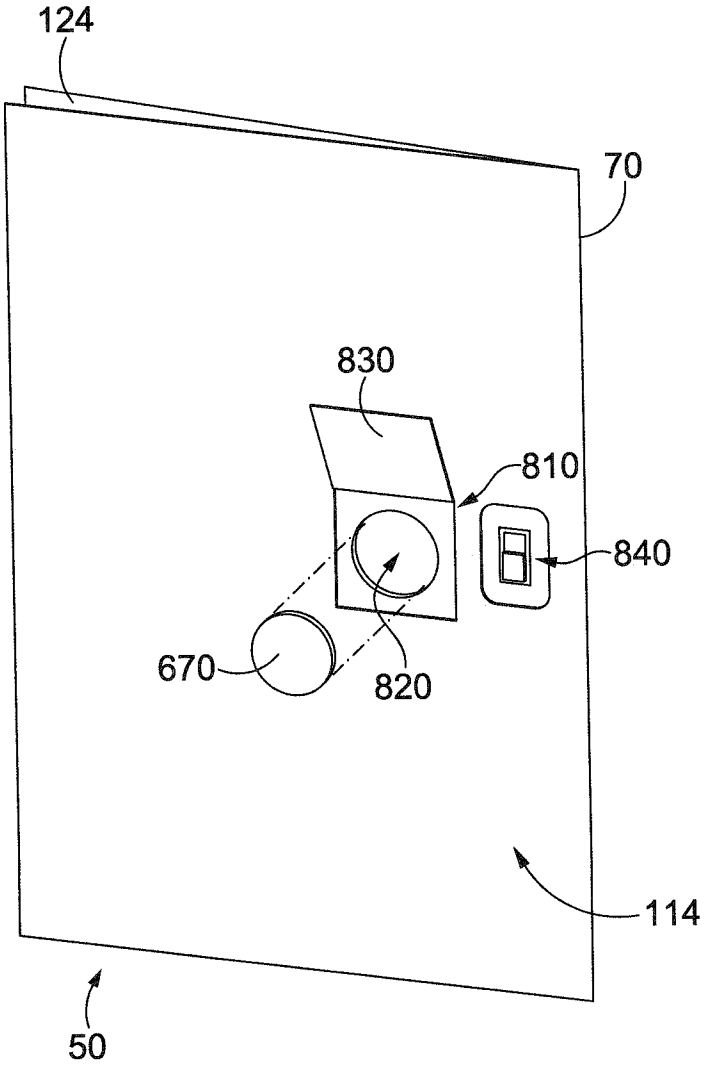
FIG. 8 is a rear perspective view of the greeting card assembly of FIG. 1, in accordance with an aspect of the disclosure.

As illustrated in FIG. 8, a rear surface 114 of the rear segment 510 of the card body 110 can present a selectively accessible compartment door, such as a flap 830, or other such cover to enable selective access to an opening. In the depicted example, opening or pivoting the flap 830 can expose a selectively-accessible chamber 820 disposed between the rear segment 510 and the front segment 520, into which a power source, such as a battery 670, can be inserted and/or removed. The rear surface 114 can also present one or more switches, such as a switch module 840, or any such manual control device coupled to the one or more processors 620, to provide a switching mechanism between different selectable modes (such as record mode and play mode) provided by the one or more processors 620. The switch module 840, in variable positions, can selectively modify a mode of the card 50, such that the one or more processors 620 can perform different operations based on gestures detected by sensor array 410 or other such triggers, as later described herein. For example, when the switch module 840 is physically actuated into a first position (e.g., a record mode), a user's gestures detected by sensor array 410 through at least the cover portion 120 and/or the front segment 520 of the card body 110 can cause the one or more processors 620 to detect an encircling touch gesture and generate, based on the detected encircling touch gesture, a corresponding touch zone for storage in memory 630. Further, the generation of the corresponding touch zone can cause the one or more processors 620 to initiate a recording of an audio clip to be associated with the generated corresponding touch zone and stored in memory 630 in association with the stored corresponding touch zone. When the switch module 840 is physically actuated into a second position (e.g., a play mode), a user's touch gesture (e.g., a push) detected by sensor array 410 through at least the cover portion 120 and/or the front segment 520 of the card body 110 and corresponding to a generated touch zone stored in memory 630, can cause the one or more processors 620 to initiate a playback of an audio clip, stored in memory 630, and associated with the generated touch zone that corresponds to the detected user's touch gesture.

In some embodiments, a sliding switch 660 can also be coupled to the audible greeting assembly 610, and can be operable to selectively supply a current (e.g., turn the card's power on) from a power source, such as battery 670, to the electronic components of the audible greeting assembly 610 when the card 50 is in the open state, as depicted in FIGS. 2-4, or selectively remove current (e.g., turn the card's power off) from the power source to the electronic components of the audible greeting assembly 610 when the card is in the closed state, as depicted in FIG. 1. In some embodiments, an actuating portion or a slider 680 of the sliding switch 660, comprising a paper or plastic tab by way of non-limiting example, can be secured or affixed (e.g., with an adhesive) to an inside surface of the cover portion 120, while the sliding switch 660 can be secured to the rear segment 510, such that pivoting the cover portion 120 into the open state actuates the sliding switch 660 to selectively supply the current, while pivoting the cover portion 120 into the closed state actuates the sliding switch 660 in an opposing direction to selectively remove the current. Among other things, the sliding switch 660 can advantageously prevent activation of the sensors 420 when the card 50 is in the closed state.

In another alternative embodiment, the sliding switch 660 can cause the one or more processors 620 to toggle between two different memory segments (e.g., sets of stored data) of the memory 630 when pivoted between the closed state and the open state. The different memory segments can include a first set of stored data including a first set of generated touch zones and associated audio clips, and a second set of stored data including a second set of generated touch zones and associated audio clips. In this way, the one or more processors 620 can generate and store a first set of touch zones and an associated first set of audio clips while the card 50 is in the closed state, and also generate and store a second set of touch zones and an associated second set of audio clips while the card 50 is in the open state. Similarly, while the card 50 is in the closed state, the one or more processors 620 can initiate a playback, via speaker 650, of a stored audio clip selected from the stored first set of audio clips based on a touch gesture detected through the cover portion 120 that corresponds to one of the stored first set of touch zones. While the card 50 is in the opened state, the one or more processors 620 can initiate a playback, via speaker 650, of a stored audio clip selected from the stored second set of audio clips based on a touch gesture detected through at least the front portion 112 and/or a photograph secured thereto that corresponds to one of the stored second set of touch zones.

The logic board of audible greeting assembly 610 can also include a variety of computer-readable media thereon or therein. Computer-readable media can be any available media that can be accessed by the components coupled on the logic board such as the processors 620 and includes both volatile and nonvolatile media, removable and non-removable media. By way of example, and not limitation, computer-readable media can comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by the various components of audible greeting assembly 610. Computer storage media does not comprise signals per se. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 630 can include computer-storage media in the form of volatile and/or nonvolatile memory. The memory can be removable, non-removable, or a combination thereof. Exemplary hardware devices include solid-state memory, hard drives, optical-disc drives, etc. The logic board of audible greeting assembly 610 can include one or more processors 620 secured thereon that read data from various entities such as memory 630 or I/O components (not shown). The memory can be operable to store computer-readable instructions for execution by one or more processors. The memory can also be operable to store media (e.g., audio files, recordings, or audio "tracks") including other data structures. In some embodiments, the data structures can be related to generated touch zones generated by one or more processors and corresponding to particular audio files, as will be described herein.

In some embodiments, the sensor array 410 is operable to detect touch gestures via any one of the plurality of sensors 420 disposed thereon. Each sensor 420 is operable to detect a touch gesture (e.g., a finger touch), such that the sensor array 410 can detect, from a user, a touch gesture from a single touch gesture conducted across one or more sensors 420 (e.g., a finger swipe). The sensor array 410 is operable to detect a single touch gesture across a plurality of sensors 420, and communicate the location (e.g., position on the sensor array 410) of each sensor that detected the single touch gesture to the one or more processors 620. In some embodiments, the sensor array 410 can be passive, such that the processor 620 detects the touch gestures based on body capacitance sensed by the individual sensors 420 on the sensor array 410. In some other embodiments, the processor 620 can detect a touch gesture based on a threshold amount of pressure sensed by the individual sensors 420 on the sensor array 410. The one or more processors 620 can be operable to receive, from the sensor array 410, a plurality of signals each corresponding to a touch gesture on a particular sensor 420 and/or a plurality of sensors 420 and a location thereof with respect to the sensor array 410.

In some further embodiments, the processor 620 can include executable instructions embedded thereon, or can read executable instructions stored in the memory 630. As such, the processor can execute instructions for generating touch zones based on the detection of one or more touch gestures encircling any subset of sensors. In some embodiments, the generation of touch zones is performed sequentially, based on the order in which the touch gestures were detected. For example, a first touch gesture detected via the sensor array 410, encircling a first group of sensors, can initiate the generation of a first touch zone by the processor 620. In other words, the first group of sensors encircled by a path defined by the first touch gesture can include all sensors included in the path as well as all sensors 420 encircled thereby. As such, the first touch zone can include all sensors 420 in the first group. In some embodiments, a second touch gesture detected via the sensor array 410, encircling a second group of sensors 420, can initiate the generation of a second touch zone by the processor 620. As a result, the second touch zone can include all sensors 420 in the second group. In some instances, the second touch gesture can overlap one or more sensors 420 included in the generated first touch zone. In such an event, the processor 620 can determine that, based on the second touch zone being generated after the first touch zone, the second touch zone has priority over the generated first touch zone. In this regard, any of the overlapped one or more sensors 420 associated with the generated first touch zone can be removed from the generated touch zone by the processor 620, and reassociated with the second touch zone by the processor 620. In some other instances, priority can be provided to the generated first touch zone, whereby the by the processor 620 does not remove overlapped sensors from the generated first touch zone, and the overlapped sensors are not reassociated with the generated second touch zone (e.g., the overlapped sensors are ignored).

In some embodiments, the processor's 620 generation of a touch zone can be performed upon a determined completion of a detected encircling touch gesture, or can be performed immediately or briefly after receiving an audio recording via microphone 640 for association with the touch zone. The term "briefly," as used herein, may refer to an amount of time less than one second, less than two seconds, or less than three seconds, for example, although recording may be programmed via the processor 620 to begin automatically at any point following a detection of an encircling gesture or a generation of a touch zone corresponding to a detected encircling gesture, without departing from the scope of the present disclosure. In some embodiments, processor 620 can generate for playback, via speaker 650, an audible feedback (e.g., a beep or voice instruction) to confirm detection of an encircling gesture or generation of a corresponding touch zone. The audible feedback can be output via speaker 650 to instruct a user to provide an audio recording corresponding to a touch zone that is being generated or was generated based on the detected encircling gesture. The processor 620 can enable microphone 640 to receive a user provided audio signal, such as a voice message, and record (e.g., store) the received audio signal to the memory 630 in association with the corresponding touch zone. In this regard, a touch zone can be generated based on the associated audio signal having been received and stored, or can be generated and stored prior to receipt and storage of the associated audio signal. In accordance with various embodiments described herein, the received audio signal can be stored as an audio clip, an audio track, an audio file, or any other term that can be reasonable interpreted as audio embodied in an electronically storable and playable format.

In some embodiments, the memory 630 can be partitioned to receive a predetermined maximum number of touch zones and/or associated audio recordings. In other embodiments, the memory partitions can limit each audio recording to a maximum recording duration. In embodiments, the processor 620 can limit an audio recording duration by generating and outputting (e.g., via speaker 650) an audible notification indicating that the maximum recording duration has been exceeded. In various embodiments, an audio recording can be stored in memory 630 with reference data (e.g., metadata) associated with a most recently generated touch zone. In other words, one or more sensor locations and or identifiers associated with the sensors included in a generated touch zone can be stored in association with an audio recording stored in memory 630.

In some other embodiments, the processor 620 can actively terminate an audio recording session (e.g., receiving an audio signal for storage in association with a touch zone) based on a received stop command. A stop command for terminating the audio recording session can be detected based on a detection of a touch gesture, by the processor 620 via the sensor array 410, corresponding to any one of the sensors encircled for generating the touch zone to be associated with the received audio signal. An audible confirmation (e.g., a playback of the audio recording or a beep) can be generated by processor 620 and output via speaker 650 upon storing the audio signal as an audio track associated with the generated touch zone.

In some embodiments, the processor 620 can detect a user's selection of a generated touch zone from a plurality of generated touch zones. For example, after the user has generated several touch zones having associated stored audio tracks, the processor can detect a user's selection of one of the touch zones to initiate playback of the audio track associated with of the selected touch zone. In some embodiments, the processor may need to be changed into a playback mode, so that touch gestures detected by the sensor array 410 and/or the processor 620 are not misinterpreted as touch zone defining inputs. In such embodiments, in order to enable touch zone generation and the storage of associated audio tracks, the processor 620 may need to be toggled into a recording mode. In embodiments, toggling an external switch, such as switch module 840 of FIG. 8, can toggle the processor 620 between the playback or recording modes. In various embodiments, the switch module can include a sliding switch, a touch or gesture-sensitive switch, a toggle switch, or any other switching mechanism adapted to toggle between two positions (e.g., playback or record) detectable by the processor 620. In some aspects, the switch module can be toggled between two or more positions, including an off position that deactivates all electrical features (e.g., playback, record) of the card by decoupling the power source from any one or more components of the audible greeting assembly.

Figure 9:
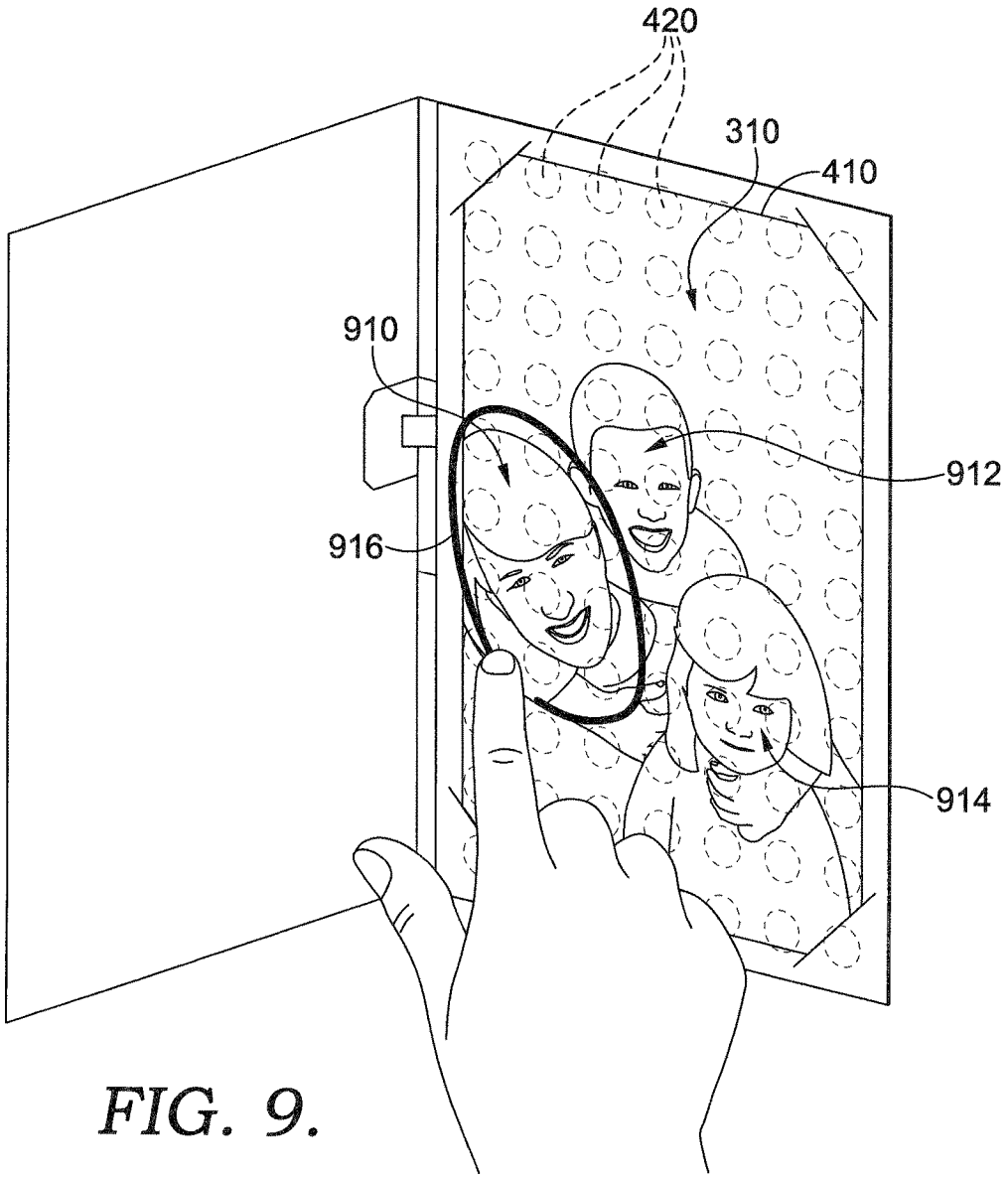
FIG. 9 is a front perspective view of the greeting card assembly of FIG. 3, depicting a user encircling a portion of the picture, defining a generated touch zone and thereby activating recording of audio associated therewith.

Turning now to FIG. 9, the illustration depicts a card, such as card 50 of FIG. 1 including sensor array 410, having exemplary photograph 310 overlaid thereon. As described herein above, the sensor array 410 can include the set of sensors 420 arranged in a grid-like format, though any configuration for presenting the sensors 420 can be employed within the scope of the present disclosure. As depicted in the exemplary photograph 310, three separate and unique objects (e.g., faces) of interest are depicted: object one 910, object two 912, and object three 914 (i.e., the faces of a mother, her son, and her daughter, respectively). In some aspects, the card 50 must receive at least a first touch gesture from a user to initiate the creation of a first generated touch zone. The first touch gesture is detected using at least, for instance, the sensor array 410 of FIGS. 4-6. In some embodiments, the first touch gesture can be or must be a first loop 916 encircling an object of the photograph, such as object one 910 in FIG. 9. The first loop 916 can be a closed loop formed around any pictures, objects, graphics, text, or even a blank space presented on the front portion 112 and/or the cover portion 120 of the card 50. The first loop 916 can be sensed by any of the sensors 420 contacted or otherwise activated via the first touch gesture. In accordance with various embodiments, a sensor 420 can be contacted or activated based on capacitance, pressure, detected distance, or the like.

The first loop 916 of FIG. 9 can initiate the generation of a first generated touch zone based on the path covered by the touch gesture. The first loop 916 includes each of the sensors 420 touched or activated by touch gesture. Enclosed within the first loop 916 is a first subset of the sensors 420. The card 50, employing the processor 620 coupled to the sensor array 410, can generate a first touch zone including a portion of the sensors 420 enclosed within the first loop 916 in addition to another portion of the sensors 420 included in the path of the first loop 916. In some embodiments, the first generated touch zone can be stored temporarily in a cache or in the memory 630 for association with an audio track, both of which can be stored in the memory 630 based on a receipt of the audio track.

In some embodiments, upon generation of the first generated touch zone, the card 50 can output an audible feedback alert to notify the user that the first touch zone has been generated or activated for generation. In accordance with the audible feedback, the card 50 can initiate an audio receiving mode that activates a microphone, such as microphone 640 of FIG. 6, to receive a first audio track for association with the first touch zone. In the audio receiving mode, an audio signal is received by the microphone 640 and stored as an audio track in a memory, such as memory 630 of FIG. 6. The audio receiving mode can be terminated (e.g., microphone deactivated and audio signal stored as audio track) based on a determined time-out (e.g., a determination by processor 620 that a defined duration has exceeded) or a received manual stop command that is detected by processor 620 based on a received touch gesture corresponding to one or more sensors of the sensor array 410. In some embodiments, the manual stop command can be detected based on a single touch gesture detected by at least one of the sensors 420 included in the first touch zone. In response to a terminated audio receiving mode, the processor 620 can initiate a playback of the first audio track or an audible feedback alert as confirmation that the first audio track was properly received and stored in memory 630. In some further embodiments, after the first audio track is received, it can be stored to the memory 630 along with a reference or similar association to the first touch zone. In some embodiments, the first touch zone can be generated to include the received first audio track, such that both the first touch zone and the first audio track are embodied as a single dataset.

In some embodiments, a second generated touch zone (not shown) can be generated based on processor 620 detecting, via sensor array 410, a second touch gesture forming a second loop encircling object two 912. In some embodiments, the sensors 420 of the second generated touch zone can include at least some of the sensors associated with the generated first touch zone (i.e., within the first loop 916). In this regard, processor 620 can determine that the generation of a subsequent second touch zone has priority over any sensors 420 on the sensor array 410 based on an order of which each touch zone is generated. In other words, to generate a subsequent second touch zone overlapping a portion of a generated first touch zone, processor 620 can remove the sensors corresponding to the overlapped portion from the first generated touch zone, such that the overlapped portion is no longer associated with the first generated touch zone. When the subsequent second touch zone is generated, the sensors corresponding to the overlapped portion, including other sensors included in the second loop, can be associated with the generated second touch zone. It is contemplated that a plurality of touch zones can be generated, and as such, any subsequently generated touch zones can be given priority over previously generated touch zones by processor 620, as described herein above.

Although FIG. 9 illustrates gestures encircling images on a picture to select an area as a touch zone to be generated, any indicia or area presented on the card assembly's cover portion 120 or card body 110 can be defined as a touch zone utilizing any type of gesture (e.g., a touch, swipe, rub) that defines a point, regular, or irregular enclosed shape, without departing from the scope of the present disclosure. For example, individuals may sign the cover portion 120 or card body 110 and then form a generated touch zone by encircling or touching their signature, thus allowing each signer to record a personal message to the individual receiving the card 50. Furthermore, in accordance with some embodiments of the present disclosure, rather than turning power on and off, the sliding switch 660 can allow a same touch zone to be used for two different audio recordings, one for when the card 50 is in the closed state and a first touch zone is touched via the cover portion 120 and one for when the first touch zone is touched via the card body 110 when the card 50 is in the open state.

The processor 620 or memory 630 can include executable instructions for determining a user's intent based on the duration of touch gestures for each sensor 420. For instance, the detection of a long input (i.e., longer than 2 seconds) from one of the plurality of sensors can trigger, via the processor 620, an activation of the microphone 640 for receiving an audio track for storage to the memory 630. The audio track can be stored to the memory 630 corresponding to the sensors 420 within a boundary formed by the gesture that triggered the activation of the microphone 640. In some embodiments, the memory 630 can be comprised of partitions, wherein each partition is configured to store an audio track received from the microphone 640 and to correspond to the sensors 420 that triggered the activation of the microphone 640 and receipt of the audio track. Such an embodiment allows for the display of a group photograph 310 on the cover portion 120 and/or the card body 110 and provides the members of the photograph 310 to record their own messages associated with the photograph. Subsequent viewers of the photograph 310 can press on individuals in the photograph 310 to hear what each of the members of the photograph 310 had to say about the photograph 310 or the event to which the photograph 310 pertained (e.g., a graduation, birthday party, etc.).

Many different arrangements of the various components depicted, as well as components not shown, are possible without departing from the scope of the claims below. In accordance with various embodiments described herein, it is contemplated that various elements of the greeting card, such as the switch, sensor array, microphone, memory, microprocessor, speaker, battery, other components of the audible greeting assembly, photograph, photograph securement means, among other elements described herein, can be secured on, affixed to, or disposed in other or alternative portions of the greeting card. An alternative embodiment of the greeting card can incorporate aspects described with respect to the card body, into a front cover or cover page of the greeting card. By way of a non-limiting example, at least some portions of the audible greeting assembly (e.g., microprocessor, memory, microphone, speaker) can be disposed within a front cover page of the greeting card (e.g., between a first and second layer of the front cover page). Moreover, the photograph securement means can be affixed to the first layer of the front cover page, such that the photograph is presented on a front cover of the greeting card. In this regard, the sensor array can be disposed within the front cover page, affixed to the first layer behind the photograph securement means, or affixed to the second layer on a rear portion of the front cover, to detect touch gestures received through a photograph secured within the photograph securement means. It is contemplated that any one of the described portions, pages, or layers of the greeting card, and any one of the components of the audible greeting assembly, can be assembled in various configurations to provide a greeting card with user-definable touch zones while remaining within the purview of the present disclosure.

Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A greeting card having user-definable touch zones, the greeting card comprising:

a body having at least a first layer that is at least partially affixed to a second layer, wherein the body includes at least one fold that defines each of a cover portion and a content portion of the greeting card, wherein based on the at least one fold, the greeting card is adapted to open to an open state that exposes the content portion and close to a closed state that hides the content portion with the cover portion; and an audible greeting assembly at least partially disposed within the body between the first layer and the second layer, the audible greeting assembly including:

a sensor array having a plurality of sensors operable to detect touch gestures through at least the first layer, a microprocessor coupled to the sensor array and configured to generate a touch zone based on a determination that a detected touch gesture encircles a set of sensors of the plurality of sensors, wherein the generated touch zone corresponds to the encircled set of sensors, a memory coupled to the microprocessor and configured to store the generated touch zone, a microphone coupled to the microprocessor and operable to receive, based on the generation of the touch zone, an associated audio track for storage in the memory, and a sliding switch, coupled to the cover portion and the microprocessor, the microprocessor being further configured to determine that the greeting card is in one of the open state and the closed state based on a corresponding position of the sliding switch, wherein the microprocessor is further configured to store the generated touch zone in a first segment of the memory when generated while the greeting card is in the closed state and in a second segment of the memory when generated while the greeting card is in the open state.

2. The greeting card of claim 1, wherein at least a portion of the first layer includes a first outer face and a first inner face, at least a portion of the second layer includes a second outer face and a second inner face, and the first layer is at least partially affixed to the second layer via the first and second inner faces.

3. The greeting card of claim 2, the audible greeting assembly further including:

a selectively accessible chamber presented through an opening of the second outer face, the selectively accessible chamber adapted to house a power supply for selectively providing a current to the audible greeting assembly.

4. The greeting card of claim 1, wherein the plurality of sensors is further operable to detect the touch gestures through the first layer and a portion of the second layer that corresponds to the cover portion when the greeting card is in the closed state.

5. The greeting card of claim 1, wherein the microprocessor is further configured to generate a different touch zone based on another determination that another detected touch gesture encircles a different set of sensors of the plurality of sensors, wherein the generated different touch zone corresponds to the encircled different set of sensors, wherein the microphone is operable to receive, based on the generation of the different touch zone, an associated different audio track for storage in the memory.

6. The greeting card of claim 5, wherein the microprocessor is further configured to determine that the encircled different set of sensors corresponding to the generated different touch zone and the encircled set of sensors corresponding to the generated touch zone each include a common subset of sensors, and based on the determination, remove the common subset of sensors from the encircled set of sensors corresponding to the generated touch zone while the common subset of sensors continue to correspond with the encircled different set of sensors.

7. The greeting card of claim 1, wherein the microprocessor is further configured to activate the microphone to receive the associated audio track based on the determination that the detected touch gesture encircles the set of sensors.

8. The greeting card of claim 1, wherein the microprocessor is further configured to select the generated touch zone based on a determination that another detected touch gesture corresponds to one of the corresponding encircled set of sensors.

9. The greeting card of claim 8, wherein the microprocessor is further configured to play back, via a speaker coupled thereto, the stored audio track associated with the generated touch zone based on the selection.

10. The greeting card of claim 8, further comprising:

a switch module coupled to the microprocessor and operable to toggle between at least a recording mode and a playback mode of the microprocessor, wherein the recording mode enables the generation of the touch zone, and the playback mode enables the selection of the generated touch zone.

11. The greeting card of claim 1, wherein the detected touch gesture defines a path that encircles the set of sensors, and wherein the generated touch zone further corresponds to another set of sensors that corresponds to the defined path.

12. The greeting card of claim 1, wherein the sensors are further operable to detect touch gestures through a photograph removably secured to the first layer.

* * * * *